US012698060B2

(12) United States Patent
Kramer et al.

(10) Patent No.: US 12,698,060 B2
(45) Date of Patent: Aug. 4, 2026

(54) BODYBOARD WITH BUILT IN SEAT

(71) Applicants: Kameron W. Kramer, San Antonio, TX (US); Courtney Jewett, San Antonio, TX (US)

(72) Inventors: Kameron W. Kramer, San Antonio, TX (US); Courtney Jewett, San Antonio, TX (US)

( * ) Notice: Subject to any disclaimer, the term of this patent is extended or adjusted under 35 U.S.C. 154(b) by 743 days.

(21) Appl. No.: 18/108,630

(22) Filed: Feb. 12, 2023

(65) Prior Publication Data

US 2024/0270352 A1 Aug. 15, 2024

(51) Int. Cl.
*B63B 32/50* (2020.01)

(52) U.S. Cl.
CPC ..... *B63B 32/50* (2020.02)

(58) Field of Classification Search
CPC ..... B63B 32/50; B63B 32/70; B63B 32/83; B63B 32/87; B63B 32/00
See application file for complete search history.

(56) References Cited

U.S. PATENT DOCUMENTS

| | | | | |
|---|---|---|---|---|
| 3,514,798 | A | 6/1970 | Ellis | |
| 3,802,374 | A | 4/1974 | Brown | |
| D305,144 | S | 12/1989 | Shanelec | |
| 5,194,026 | A | 3/1993 | Corwin et al. | |
| 5,224,890 | A | 7/1993 | Moran | |
| 5,733,000 | A | 3/1998 | Stump | |
| 6,203,389 | B1 | 3/2001 | Pearson | |
| 6,890,226 | B2 | 5/2005 | Wang | |
| 9,290,245 | B2 * | 3/2016 | Bishop | B63B 32/70 |
| 11,884,369 | B2 * | 1/2024 | Cannon | B63B 32/70 |
| 2008/0194161 | A1 | 8/2008 | Lin | |
| 2009/0270002 | A1 * | 10/2009 | Crispin | B63B 32/77 441/74 |
| 2012/0149259 | A1 | 6/2012 | Proton et al. | |
| 2021/0070404 | A1 * | 3/2021 | LaProcido | B63B 32/87 |
| 2022/0204142 | A1 * | 6/2022 | LaProcido | B63B 32/77 |

FOREIGN PATENT DOCUMENTS

| | | | | |
|---|---|---|---|---|
| WO | WO-2011100186 A2 * | 8/2011 | | B63B 32/70 |

* cited by examiner

*Primary Examiner* — Anthony D Wiest

(74) *Attorney, Agent, or Firm* — Kameron W. Kramer

(57) ABSTRACT

A bodyboard is provided that comprises a built in seat and a hook that allows a tether to be utilized as a carrying strap or straps. The backrest of the seat is built into the body of the bodyboard and hinges to the open position when needed. When the backrest is not in use, it fits securely in the body of the bodyboard and does not affect the desired results of the bodyboard in the water.

6 Claims, 3 Drawing Sheets

BODYBOARD WITH BUILT IN SEAT

TECHNICAL FIELD

The present disclosure relates to bodyboard, and more specifically, to a bodyboard that provides a built in seat.

PRIOR ART AND BACKGROUND

Bodyboards can be traced back to the Indigenous Polynesians who rode wooden "alaia" boards on their belly, knees, or feet. Tom Morey invented the first modern bodyboard in 1971 known as the "Boogie Board." The bodyboard differs from a surfboard because it is much shorter, typically 38 to 43 inches in length, and is made out of various types of foam. Essentially, bodyboards are small, flexible, and lightweight, allowing riders to ride waves on their belly without a surfboard. Bodyboarding now refers both to a simple, accessible board riding activity as well as a popular sport throughout the world. The modern bodyboard is comprised of a foam core encapsulated by a plastic bottom, a softer foam top (the deck), and softer foam sides (the rails). The core is made of a firm, typically buoyant, material. The bottom is typically made of some type of polymer that allows the bodyboard to flow through the water easily. Bodyboards typically have a tether that attaches to the bodyboard and can be easily attached to the user, usually by a wrist strap. The tether ensures that the bodyboard will not be lost at sea if the user falls off the bodyboard while riding.

Bodyboards are common in the prior art, including innovations to improve the bodyboards. U.S. Pat. No. 6,203,389B1 titled "Bodyboard" to Pearson, US20080194161A1 titled "Bodyboard" to Lin, U.S. Pat. No. 5,224,890A titled "Bodyboard with variable stiffness" to Moran, and USD305144S titled "Bodysurfing board" to Shanelec are all inventions that seek to add improvements to the bodyboard.

Bodyboards can be difficult to carry as they are large and can easily catch the wind. US20120149259A1 titled "Carrying strap for bodyboard" to Proton et al. provides a carrying strap for bodyboards. In addition to the difficulty of carrying just a bodyboard, users going to the beach are oftentimes carrying many other items, including chairs. There exists a need for an easy to carry bodyboard that also provides adequate seating on the beach. The present invention overcomes the shortcoming contained in the prior art by providing an easy to carry bodyboard that provides a seat that is reliable, cheap, efficient in the water, and easy to use.

SUMMARY OF THE INVENTION

The present disclosure provides a bodyboard, comprising a board; an opening, wherein the opening is located in the top side of the board and creates an inner surface part way through the board that is substantially parallel to the board; an insert piece, wherein the insert piece is disposed in the opening and one end of the insert piece is hingeably attached to the inner surface; a pair of insert piece support lines, wherein the insert piece support lines are securably attached to the inner surface and the distal end of insert piece; a tether, wherein the tether is securably attached to the top side of the board; a ring, wherein the ring is securably attached to the distal end of the tether; and a hook, wherein the hook is securably attached to the board.

In an alternate embodiment, the present disclosure provides a bodyboard, comprising a board; an opening, wherein the opening is located in the top side of the board and creates an inner surface part way through the board that is substantially parallel to the board; an insert piece, wherein the insert piece is disposed in the opening and one end of the insert piece is hingeably attached to the inner surface; a tether, wherein the tether is securably attached to the top side of the board; a ring, wherein the ring is securably attached to the distal end of the tether; and a hook, wherein the hook is securably attached to the board.

None of the prior art fully addresses the problems resolved by the present invention. The present invention overcomes these limitations contained in the prior art.

Certain embodiments of the invention have other steps or elements in addition to or in place of those mentioned above. The steps or element will become apparent to those skilled in the art from a reading of the following detailed description when taken with reference to the accompanying figures, if any.

DETAILED DESCRIPTION OF THE INVENTION

Figure 1:
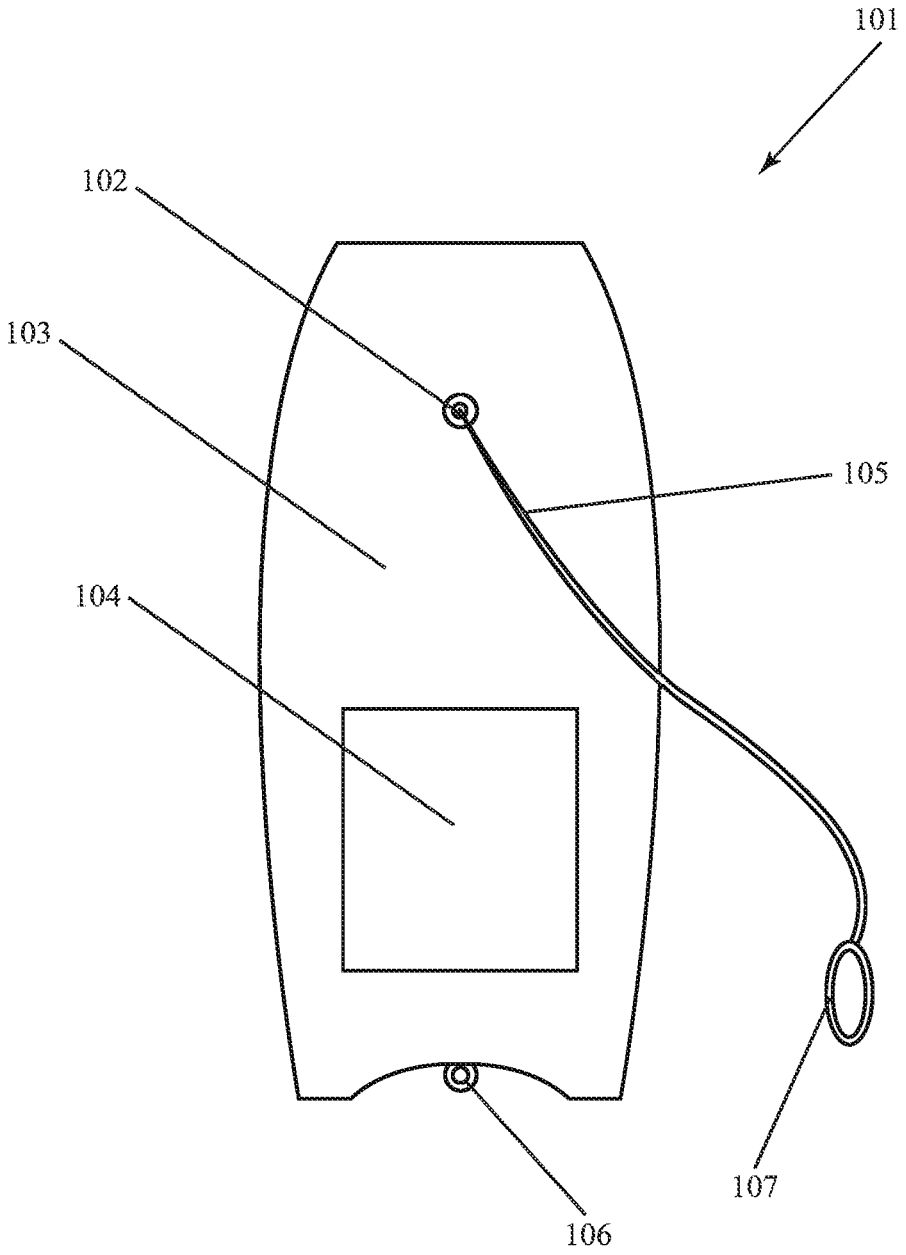
FIG. 1 illustrates a top down view of the bodyboard of the present invention.

The best mode for carrying out the invention will be described herein. The following embodiments are described in sufficient detail to enable those skilled in the art to make and use the invention. It is to be understood that other embodiments would be evident based on the present disclosure, and that system, process, or mechanical changes may be made without departing from the scope of the present invention.

In the following description, numerous specific details are given to provide a thorough understanding of the invention. However, it will be apparent that the invention may be practiced without these specific details. To avoid obscuring the present invention, some well-known system configurations, and process steps are not disclosed in detail. The figures illustrating embodiments of the system, if any, are semi-diagrammatic and not to scale and, particularly, some of the dimensions are for the clarity of presentation and are shown exaggerated in the drawing figures.

Alternate embodiments have been included throughout, and the order of such are not intended to have any other significance or provide limitations for the present invention.

For expository purposes, the term "horizontal" as used herein is defined as a plane parallel to the plane or surface of the present apparatus, regardless of its orientation. The term "vertical" refers to a direction perpendicular to the horizontal as just defined. Terms, such as "above", "below", "bottom", "top", "side", "higher", "lower", "upper", "over", and "under", are defined with respect to the horizontal plane, as shown in the figures, if any. The term "on" means that there is direct contact among elements.

The present disclosure provides a bodyboard, comprising a board; an opening, wherein the opening is located in the top side of the board and creates an inner surface part way through the board that is substantially parallel to the board; an insert piece, wherein the insert piece is disposed in the opening and one end of the insert piece is hingeably attached to the inner surface; a pair of insert piece support lines, wherein the insert piece support lines are securably attached to the inner surface and the distal end of insert piece; a tether, wherein the tether is securably attached to the top side of the board; a ring, wherein the ring is securably attached to the distal end of the tether; and a hook, wherein the hook is securably attached to the board.

In an alternate embodiment, the present disclosure provides a bodyboard, comprising a board; an opening, wherein the opening is located in the top side of the board and creates an inner surface part way through the board that is substantially parallel to the board; an insert piece, wherein the insert piece is disposed in the opening and one end of the insert piece is hingeably attached to the inner surface; a tether, wherein the tether is securably attached to the top side of the board; a ring, wherein the ring is securably attached to the distal end of the tether; and a hook, wherein the hook is securably attached to the board.

FIG. 1 illustrates a top down view of bodyboard 101 of the present invention. Board top side 103 is shown. Insert piece 104 is disposed in board top side 103 and is shown in the closed position. Tether 105 is securably attached to board top side 103 of bodyboard 101 at connection point 102. Ring 107 is securably attached to the distal end of tether 105. Hook 106 is securably attached to bodyboard 101. Ring 107 is typically secured around the wrist of the user to ensure that bodyboard 101 is not lost when using bodyboard 101 in the water.

Figure 2:
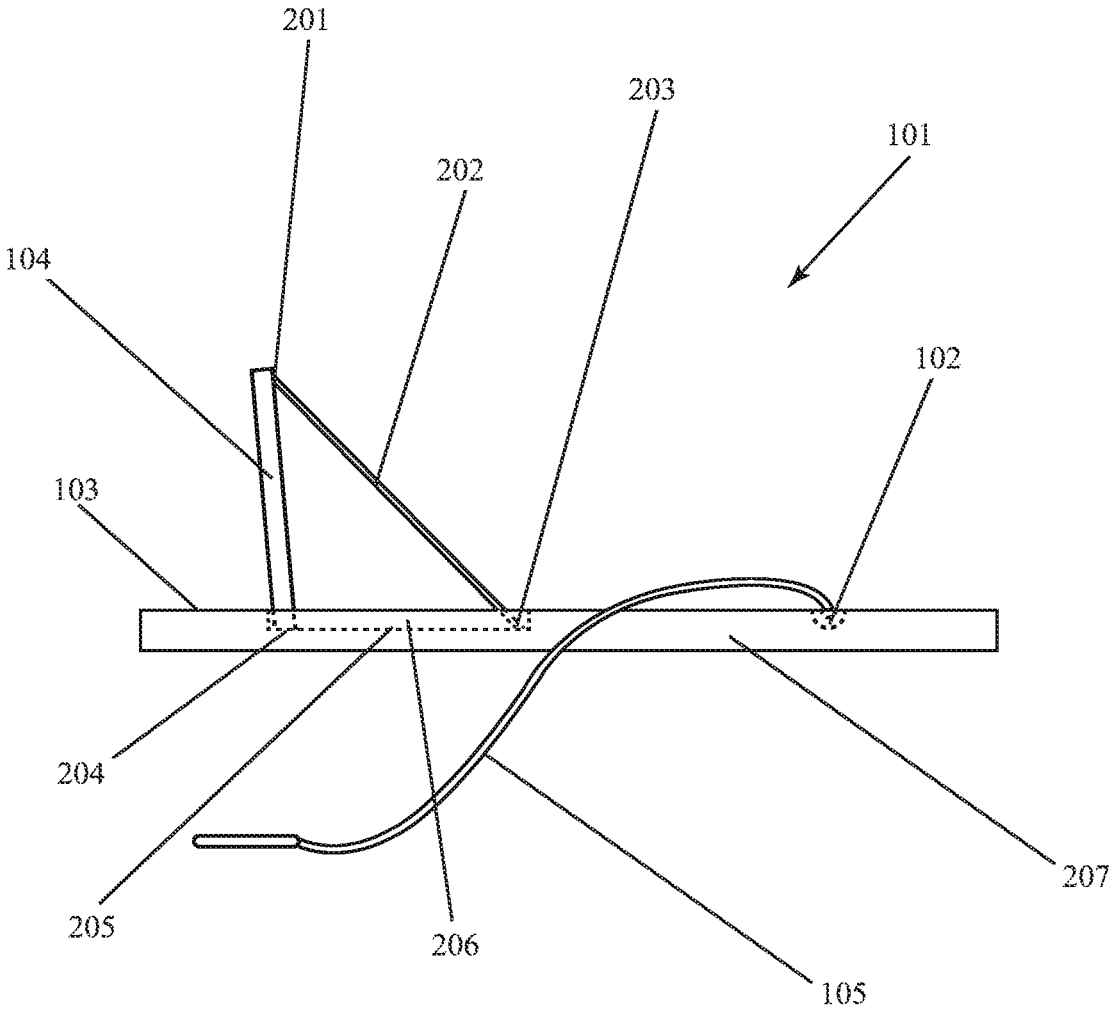
FIG. 2 illustrates a side view of the bodyboard of the present invention.

FIG. 2 illustrates a side view of bodyboard 101 of the present invention. Insert piece 104 is shown in the open position. Board side wall 207 continues around the entire perimeter of board top side 103. Insert piece 104 is shown in the open position. A pair of insert piece support lines 202 and 202' are securably attached to inner surface 205 at inner connection points 203 and 203' and the distal end of insert piece 104 at inner piece connection points 201 and 201'. Corresponding pieces denoted by the apostrophe (') are not shown in this figure. Insert piece 104 is hingeably attached to inner surface 205 at inner hinge connection point 204. Opening 206 extends partway through the depth of board side wall 207 and is open on board top side 103. Insert piece 104 is substantially the same thickness as opening 206.

Figure 3:
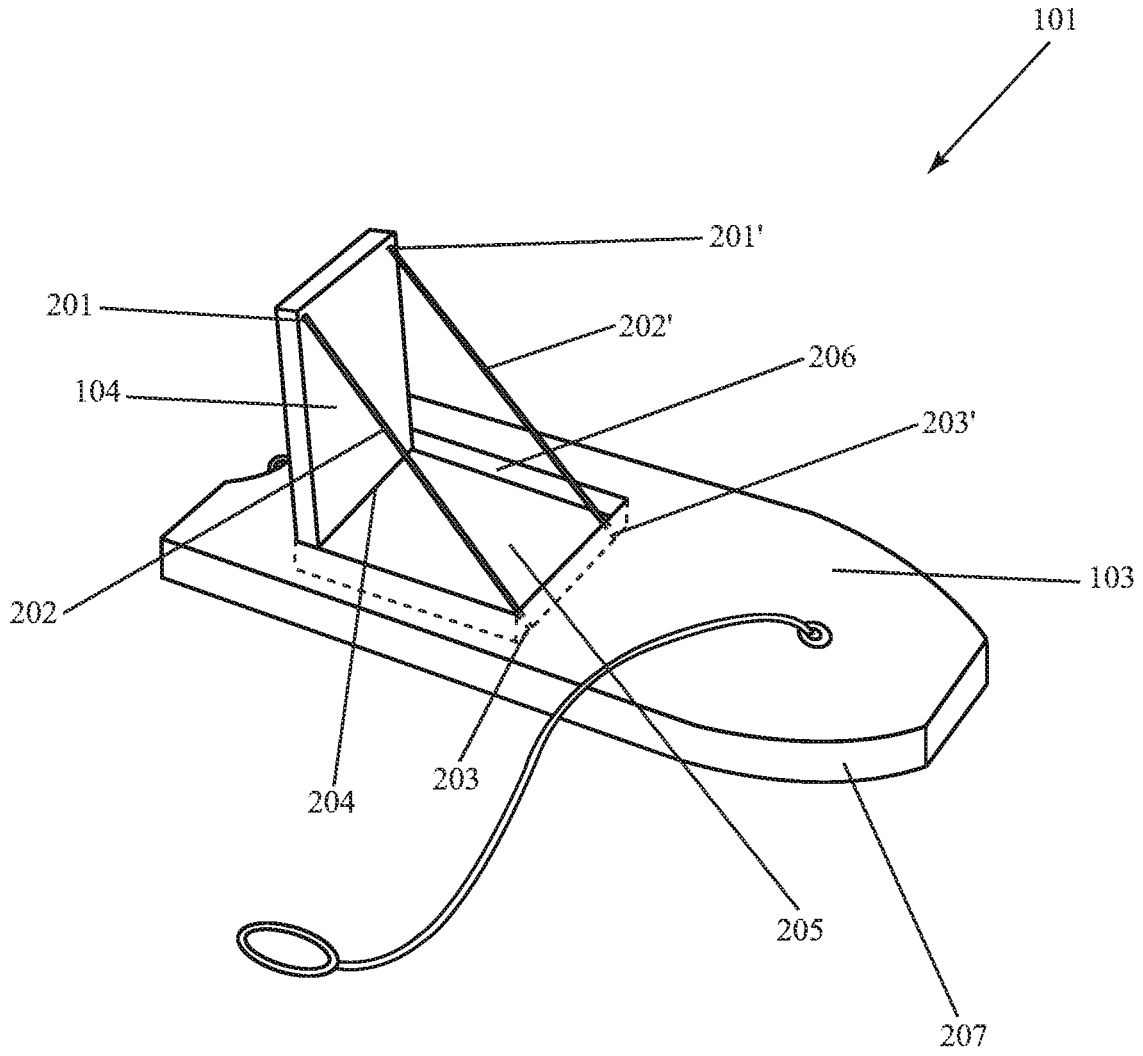
FIG. 3 illustrates a perspective view of the bodyboard of the present invention.

FIG. 3 illustrates a perspective view of the bodyboard 101 of the present invention. Bodyboard 101 comprises board top side 103 and board side 207. Board side wall 207 continues around the entire perimeter of board top side 103. Bottom side of bodyboard 101 is not shown but is substantially the same size as board top side 103. The pair of insert piece support lines 202 and 202' are securably attached to inner surface 205 at inner connection points 203 and 203' and the distal end of insert piece 104 at inner piece connection points 201 and 201'.

Insert piece support lines 202 and 202' comprise any type of suitable material, such as nylon, rubber, etc., that provides the proper function of bodyboard 101.

When insert piece 104 is in the open position, a user can sit on inner surface 205 in opening 206. Insert piece 104 acts as the backrest for a user when user is sitting in opening 206 and on inner surface 205. Insert piece support lines 202 and 202' provide support for insert piece 104 when the user's back is placed against insert piece 104. When insert piece 104 is in the closed position, insert piece 104 sits in opening 206 and is flush with board top side 103 and insert piece support lines 202 and 202' fold underneath insert piece 104. Insert piece 104 fills opening 206 such that water, sand, and other materials cannot easily enter opening 206 when insert piece 104 is in the closed position.

Inner hinge connection point 204 comprises a hinge that allows insert piece 104 to be hingeably attached to bodyboard 101. Inner hinge connection point 204 is hingeably attached to inner surface 205 and insert piece 104. The hinge of inner hinge connection point 204 comprises any suitable hinge that allow insert piece 104 to open and close with respect to opening 206.

Insert piece 104 may comprise a means to allow a user to easily put insert piece 104 in the open position.

Hook 106 is securably attached to bodyboard 101. Hook 106 may comprise any type of connection point that allows the tether 105 or ring 107 to be securably attached to bodyboard 101, including, but not limited to, an open hook, a closed loop, a carabiner, etc. Tether 105 or ring 107 may be connected to hook 106 to form a loop. The loop can be used by a user to carry bodyboard 101 on their back like a one strap backpack. Hook 106 is disposed on the rear part of board side wall 207 such that it does not interfere with the functionality of bodyboard 101 when in use in the water.

Tether 105 may comprise any number of pieces that are all securably attached to board top side 103 of bodyboard 101 at connection point 102. If tether 105 comprises more than one piece, the pieces can be separated to form multiple straps to allow a user to wear bodyboard 101 like a multi-strap backpack.

Ring 107 comprises an adjustable ring that allows the user to put ring 107 securely around their wrist. Ring 107 may further comprise adjustability whereby it securely attaches to hook 106. Ring 107 may comprise any type of connection that allows it to be easily and securely secured to a user.

Opening 206 and/or inner surface 205 may comprise additional compartments to allow for belongings to be stored when insert piece 104 is in the closed position.

In one embodiment of the present invention, insert piece support lines 202 and 202' are not present, and the hinge of inner hinge connection point 204 provides the necessary support of insert piece 104 when in the open position.

In one embodiment of the present invention, bodyboard 101 comprises a connection point for an umbrella or other shade device to be attached and held in place.

In one embodiment of the present invention, tether 105 provides the needed support for insert piece 104 when in the open position. In this embodiment, tether 105 attaches to, or near, the top of insert piece 104 and then attaches to hook 106 in order to provide the needed support for insert piece 104 when in the open position.

The best mode for carrying out the invention has been described herein. The previous embodiments are described in sufficient detail to enable those skilled in the art to make and use the invention. It is to be understood that other embodiments would be evident based on the present disclosure, and that system, process, or mechanical changes may be made without departing from the scope of the present invention.

In the previous description, numerous specific details and examples are given to provide a thorough understanding of the invention. However, it will be apparent that the invention may be practiced without these specific details and specific examples. While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations that fall within the scope of the included claims. All matters previously set forth herein or shown in the accompanying figures are to be interpreted in an illustrative and non-limiting sense.

What is claimed is:

1. A bodyboard, comprising:

a board;

an opening, wherein the opening is located in a top side of the board and creates an inner surface part way through the board that is substantially parallel to the board;

an insert piece, wherein the insert piece is disposed in the opening of the board and one end of the insert piece is hingeably attached to the inner surface, wherein when the insert piece is in an open position, the insert piece acts as a backrest for a user when the user is sitting in the opening on the inner surface wherein when the insert piece is in a closed position, the insert piece is flush with the top side of the board in the opening;

a pair of insert piece support lines, wherein the insert piece support lines are securably attached to the inner surface and a distal end of the insert piece;

a tether, wherein the tether is securably attached to the top side of the board;

a ring, wherein the ring is securably attached to a distal end of the tether; and a hook, wherein the hook is securably attached to the board.

2. The bodyboard of claim 1, wherein when the insert piece is in a closed position the pair of insert piece support lines are disposed on the inner surface in the opening.

3. The bodyboard of claim 1, wherein the ring and hook are connectable.

4. The bodyboard of claim 1, wherein the ring and hook connect to form a loop.

5. The bodyboard of claim 1, wherein the tether and hook are connectable.

6. The bodyboard of claim 1, wherein the tether and hook connect to form a loop.

* * * * *